US005460597A

United States Patent [19]

Hopper

[11] Patent Number: 5,460,597

[45] Date of Patent: Oct. 24, 1995

[54] PORTABLE HAND-HELD VIBRATORY FEMININE STIMULATOR

[76] Inventor: George Hopper, 8340 Greensboro Dr. #402, McLean, Va. 22182

[21] Appl. No.: 289,263

[22] Filed: Aug. 11, 1994

Related U.S. Application Data

[63] Continuation-in-part of Ser. No. 217,881, Mar. 25, 1994, abandoned.

[51] Int. Cl.[6] ..... A61H 7/00

[52] U.S. Cl. ..... 601/84; 601/87; 601/93; 601/101; 601/134

[58] Field of Search ..... 446/395, 337, 446/373; 601/84, 46, 69, 70, 72, 78, 80, 81, 85, 87, 88, 89, 93–97, 101, 107, 108, 112, 134, 136

[56] References Cited

U.S. PATENT DOCUMENTS

| | | | |
|---|---|---|---|
| 3,504,665 | 4/1970 | Bakunin | 601/93 |
| 3,978,851 | 9/1976 | Sobel | 601/95 |
| 3,991,751 | 11/1976 | O'Rourke . | |
| 4,033,338 | 7/1977 | Igwebike . | |
| 4,722,327 | 2/1988 | Harvey | 601/97 |
| 4,790,296 | 12/1988 | Segal | 601/97 |
| 4,825,853 | 5/1989 | Iwamoto et al. . | |
| 4,846,158 | 7/1989 | Teranashi . | |
| 5,067,480 | 11/1991 | Woog et al. . | |
| 5,076,261 | 12/1991 | Black | 601/93 |
| 5,085,207 | 2/1992 | Fiore . | |
| 5,183,034 | 2/1993 | Yamasaki et al. . | |
| 5,211,161 | 5/1993 | Stef | 601/5 |

*Primary Examiner*—Robert A. Hafer
*Assistant Examiner*—David J. Keanealy

[57] ABSTRACT

A stimulator for use in marital orgasmic and sexual therapy for performing a simulation of cunnilingus is provided. The stimulator has an elongated cylindrical housing, simulated lips, a simulated tongue and is battery powered. The tongue is caused to move in and out with respect to the simulated lips; up and down; and side to side. These motions are attainable independently of the others. Three motors, separate switches, and three sets of cooperating but independent linkage are provided to accomplish this motion arrangement. A finger operated plunger type dispenser integral to the housing dispenses lubricant, medication, or other fluid onto the simulated tongue.

14 Claims, 6 Drawing Sheets

PORTABLE HAND-HELD VIBRATORY FEMININE STIMULATOR

REFERENCE TO RELATED APPLICATION

This application is a continuation-in-part of Ser. No. 08/217,881, filed Mar. 25, 1994 now abandoned.

BACKGROUND OF THE INVENTION

1. Field of the Invention

The present invention relates to a portable vibratory feminine stimulator for use in marital and sexual therapy.

2. Description of the Prior Art

Within the last several decades, the existence and desirability of the female orgasm has been virtually universally accepted by civilized society. Yet it is equally well established that a large percentage of women do not orgasm regularly during sexual intercourse, the use of ordinary vibrators or the use of self-stimulation. Indeed, a substantial minority of women report that they rarely, if ever, orgasm through the aforementioned three methods and only orgasm through the means of cunnilingus. For a substantial number of married couples, this can lead to tension and frustration which, in turn, leads to marital discord, especially if the husband has a dislike for performing cunnilingus or an inability to perform cunnilingus. Assuming that this is not a result of lack of facility on the part of the husband or intractable trauma based psychological problems on the wife's part, orgasmic therapy with a device which can perform a simulation of cunnilingus can replace or substantially supplement traditional marital therapy for such troubled couples.

Usually, orgasmic therapy for women involves self-stimulation. While arguments have persisted for years whether internal orgasms were a more mature form of orgasm than external orgasms or merely the result of indirect external pressure, the fact remains that external stimulation coupled with internal stimulation as occurs when cunnilingus is performed on a woman, tends to lead to more satisfying female orgasms.

As sexually dysfunctional women are unable to self-stimulate themselves in the same method as is used during cunnilingus, a mechanical device such as a vibrator which is capable of performing a simulation of cunnilingus may be required for effective marital therapy. Similarly, a vibrator is preferred over seeking the wife out other partners to perform cunnilingus since a mechanical device is normally more hygienic, is less likely to cause hurt feelings on the part of the husband and is able to achieve high vibrational rates which cannot be achieved orally. Furthermore, in the latter stages of therapy, a vibrator may allow the patient to continue stimulation past the initial orgasm to achieve multiple orgasms. This is in contradistinction to oral stimulation, wherein a man may be unable or unwilling to continue the oral stimulation of the woman past the initial orgasm.

After therapy is discontinued the couple can continue to use the vibrator or marital aid on a maintenance or recreational program. Similarly, a vibrator can be used in the context of a married couple which is certainly not dysfunctional, yet wherein the wife simply has a greater sexual appetite for cunnilingus or is slower to respond and climax than is the husband.

Additionally, it is well established that the female orgasm relieves cramps, a major source of irritability during menstruation. However, many wives are reluctant to engage in cunnilingus with their husband during menstruation. A vibrator for performing a simulation of cunnilingus can be used in such a context for relief of cramps and irritability associated with menstruation.

Moreover, a vibrator for the performance of a simulation of cunnilingus can be used for socially desirable, yet less than therapeutic, purposes. For example, the disabled or elderly can use a vibrator for the performance of a simulation of cunnilingus to induce orgasms after the death, desertion or lack of capacity or availability of a spouse. The socially desirable goal of marital fidelity may be achieved by a woman having access to a vibrator for the performance of a simulation of cunnilingus while her husband is injured, ill or absent for long periods. Similarly, in view of the prevalence of sexually transmitted diseases today, a vibrator for the performance of a simulation of cunnilingus is desirable in that it allows a single woman to experience orgasm and relieve tension more satisfactorily and reliably than by resorting to indiscriminate premarital sexual intercourse which frequently leads to undesirable and dangerous consequences.

In the prior art, vibrators are frequently phallic shaped to simulate the movement of a husband's sexual organ. The prevalence of this kind of vibrator is possibly the result of male misunderstanding of the process of female orgasm. As previously described, cunnilingus is the method of choice for many married women. Similarly, possibly due to male misunderstandings of female sensitivities or the maladaptation of devices originally designed as back, shoulder or scalp massagers, many vibrators in the prior art are unnecessarily rough and therefore are not suitable for marital orgasmic therapy. In vibrators of the prior, agitation is necessarily harsher because the vibrations are designed to cover a wider area, thereby causing a risk of irritation to soft tissue and mucosa traumatization which is unsuitable for marital orgasmic therapy. Indeed, at least one vibrator of the prior art incorporated a "hammering" motion while none of the prior art vibrators are capable of performing a simulation of cunnilingus.

Furthermore, the vibrating motion itself may be undesirable. However, the prior art has unquestioningly and unscientifically accepted this form of motion as several million vibrators of the prior art have been sold for the past several decades. Vibrators of the prior art have typically vibrated or "hammered" through an angle of only 10–80 degrees so that they would slide off the clitoris or desired area easily and be incapable of performing a simulation of cunnilingus, therefore forcing the marital therapy patient whom is most susceptible to cunnilingus or even incapable of orgasm through sexual intercourse or normal manual stimulation to repeatedly go from a mid-point of arousal back to the beginning of arousal.

Furthermore, in vibrators of the prior art, typically only one range of operation is provided. This is not well suited for applications wherein the woman with a wide range of sensitivities including a particular predilection and susceptibility for cunnilingus are to be treated.

U.S. Pat. No. 5,183,034 issued to Yoshikiyo Yamasaki et al. on Feb. 2, 1993 discloses a Portable Vibratory Finger Pressure Massager having massaging balls which can perform relative swinging motion and which can optionally cause a finger pressure massage, vibration or the like for back and body massages. The portable massages has a vibrator structure disposed in each massaging ball and vibration isolation boards which can absorb noise and vibration disposed on the rotating structure which can rotate the massaging balls. A spring is disposed at the center of a thin shaft to support the massaging ball to provide a stable massage without an uncomfortable feeling.

U.S. Pat. No. 5,067,480 issued to Philippe-Guy E. Woog et al. on Nov. 26, 1991 discloses a Stimulator for use in marital orgasmic therapy. This stimulator has a step-down transformer and a water-proof case where the stimulator oscillates at 2000–8000 cycles per minute throughout an angle of operation chosen from the range of 10 to 80 degrees. An integrated set includes several different detachable attachments and a handle with mechanical oscillating means.

U.S. Pat. No. 4,846,158 issued to Akihiko Teranishi on Jul. 11, 1989 discloses a Hand Type Electric Massage Machine with a vibration head connected through a coupling spring to a top end portion of a hand case and an unbalanced weight rotatably mounted to a top end portion of a rotary shaft so that the center of gravity of weight element is positioned on a line extending radially from a bearing of the rotary shaft. The weight element is fixed to a part of the periphery of a lower end portion of a cylinder base having a nearly covered cylindrical form including a disc portion and a skirt portion extending downward from the periphery of the disc portion. According to another feature of the Teranashi invention, the longitudinal ends of the vibration head are respectively provided with a curved surface extending in a vertical direction and with a curved projection surface having a smaller radius of curvature than that of the aforementioned curved surface and lateral sides thereof include a spherical surface member having an elastic body and with a spherical surface member having a number of small projections, respectively. The size of the bearing can be varied and lubricating oil is not scattered with the massage machine being suitable for massage in various modes.

U.S. Pat. No. 4,825,853, issued May 2, 1989 to Hironori Iwamoto et al. discloses a hand held vibratory massager discloses a vibratory massager with a self-contained applicator head which is resiliently connected to a hand grip for limited movement in substantially all directions relative to the hand grip. A drive motor and an eccentric flyweight are mounted together within the applicator head for making it as a self-contained vibrating unit. The eccentric flyweight is connected to a motor output shaft in an eccentric relation thereto for imparting vibration to the applicator head upon rotation of the output shaft. Also mounted within the applicator head is a counterweight which provides dynamic balancing of the applicator head in such a manner as to align the center of mass of the entire applicator head with that of the flyweight in a plane perpendicular to the center axis of the applicator head.

U.S. Pat. No. 4,033,338, issued Jul. 5, 1977 to Kingsley Igwebike discloses a vibratory feminine hygiene vacuum device which includes an elongated flexible tubular intake portion for insertion into the vaginal tract. A motor driven centrifugal impeller within the device creates a radially inward air flow through plural intake ports in the tubular wall of the intake portion. An arm within the intake portion extends radially from a longitudinally directed motor driven rotating shaft and engages the interior wall of the intake portion. The intake portion undergoes a vibratory flexure in response to rotation of the shaft.

U.S. Pat. No. 3,991,751, issued Nov. 16, 1976 to Jessie O'Rourke discloses a portable vibrator with a tubular housing dimensioned to be held in a hand and with an open neck end. The housing has a predetermined diameter throughout its length and a diameter smaller than the predetermined diameter at the neck end thereof and is rounded down at its neck end from the predetermined diameter to the smaller diameter. A head is removably affixed to the housing at the neck end thereof and has the predetermined diameter at an intermediate part thereof. The head has the smaller diameter at the end affixed to the housing and is rounded down at its affixed end from the predetermined diameter to the smaller diameter thereby forming an annular trough-like indentation in the area of the neck end of the housing. An electric vibrating device in the housing vibrates the head.

U.S. Pat. No. 5,085,207, issued Feb. 4, 1992 to Russell D. Fiore discloses a massage device having three driven massage elements and a drive motor. A transmission arrangement enables a central massage element to both rotate and wobble, while two surrounding massage elements rotate only. The purpose of the outside elements is to stabilize contact of the novel device with respect to the skin, while the central element performs the actual massage. It should be noted that the three elements of Fiore's device cannot act independently of one another, and that the outer two elements merely rotate.

None of the above inventions and patents, taken either singly or in combination, is seen to describe the instant invention as claimed.

SUMMARY OF THE INVENTION

The present invention provides a unitary, hand held appliance comprising a stationary housing and a simulated, movable tongue projecting from the housing. The housing is generally cylindrical, and has external control buttons. The forward end of the housing is configured to simulate a human mouth, and it is from this end that the tongue projects. The tongue has a tip for contacting and stimulating sensitive anatomical parts.

Within the housing are motors and mechanical transmissions enabling the tongue to respond as desired by the operator. The transmissions are so designed that three motions are independently attainable. These motions include reciprocating, forward and backward motion, which would correspond to entering and withdrawing from the vagina, pivoting up and down motion, and pivoting side to side motion. In the last two motions, the tip of the simulated tongue is caused to move up and down, or side to side, or both simultaneously.

Obviously, a hand held appliance may be held in many positions, so that the terms "up and down" and "side to side" are significant in that they differentiate each said motion from the other. In other words, the tip of the simulated tongue is selectively pivoted in one or two planes which are perpendicular to one another and both of which planes contain a line along which the tongue moves when moving forwardly and backwardly.

In a preferred embodiment, separate switches control the speed of each type of motion independently from the others. Additional switches vary the applied voltage to selected motors so as to vary the speed with which each respective motion is performed.

The device is preferably battery powered, since the low voltage of commonly available battery cells is inherently safe. Also, the appliance is fully self-contained when battery cells carried on board supply the necessary power. However, it would be possible to employ AC electrical power conducted from commercial or household power from a power cord.

Accordingly, it is a principal object of the invention to provide a stimulator or marital aid for direct external and/or internal stimulation of the clitoris and vagina in a simulation of cunnilingus for marital or sexual orgasmic therapy.

It is another object of the invention to provide a stimulator having a member simulating the feel of a human tongue.

It is a further object of the invention to provide a stimulator or marital aid which departs from the traditional vibrating, even "hammering" motion or action by simulating cunnilingus.

Still another object of the invention is to provide a stimulator which causes the tongue to reciprocate forwardly and backwardly.

An additional object of the invention is to cause the simulated tongue to move up and down.

A further object of the invention is to cause the simulated tongue to move from side to side.

It is again an object of the invention to cause the simulated tongue to provide any combination of forward and backward, up and down, and side to side motion.

It is therefore a still further object of this invention to provide an appliance which is light and easy to hold while being portable.

Yet another object of the invention is to vary the speed of each possible motion selectively.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF TEE PREFERRED EMBODIMENT

Figure 1:
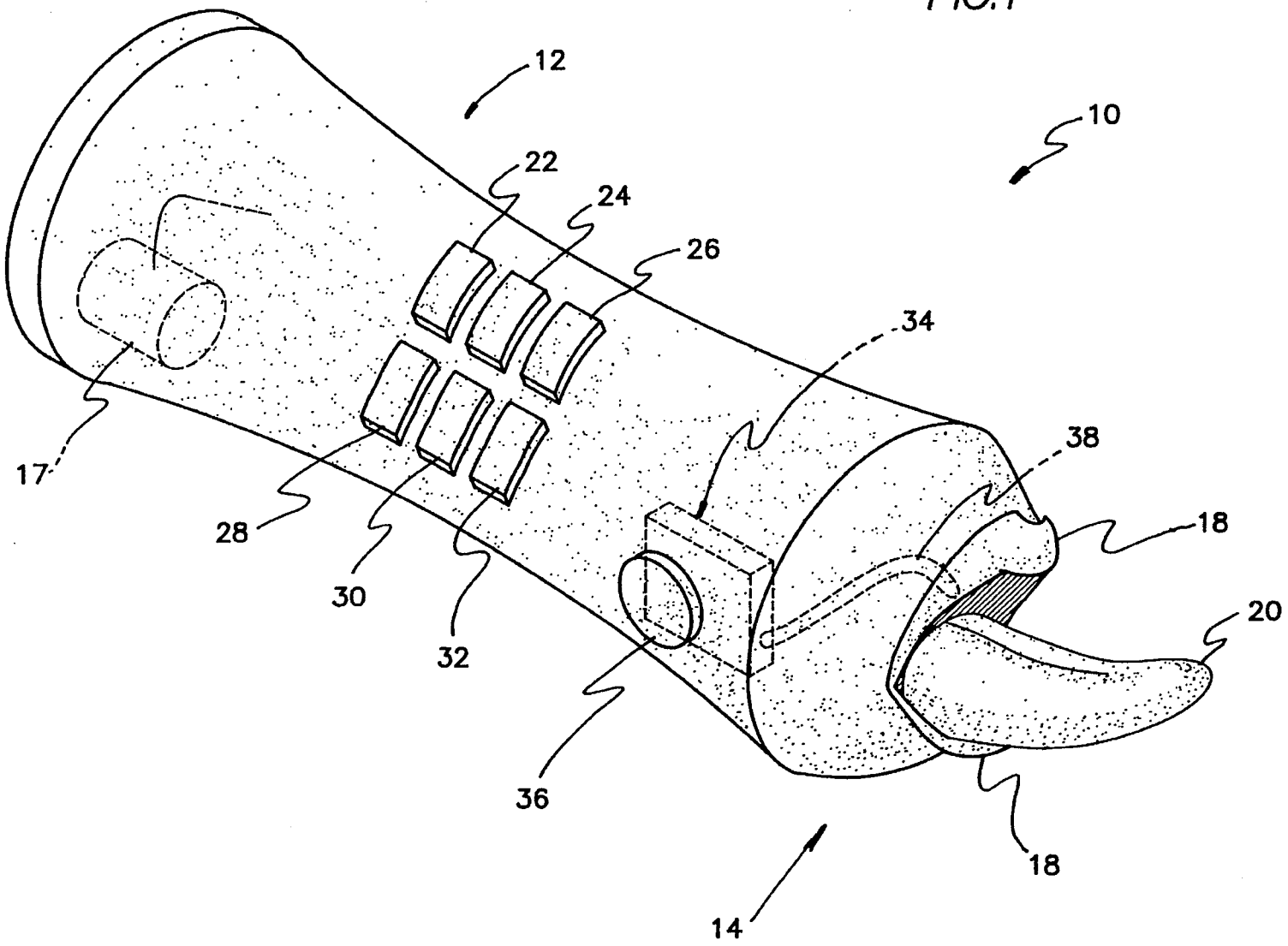
FIG. 1 is a perspective side view of a portable hand-held vibratory feminine stimulator according to the present invention.

The present invention is a portable hand-held vibratory feminine stimulator 10 which performs a simulation of cunnilingus. As seen in FIG. 1, stimulator 10 includes a housing 12 of generally cylindrical configuration. Forward end 14 of housing 12 includes a simulated mouth including upper and lower lips 18 and a tongue 20. An opening is defined by lips 18, and communicates between the interior of housing 12 and the exterior. Tongue 20 is caused to move in and out of this opening, as well as in other ways which are described elsewhere herein.

Figure 3:
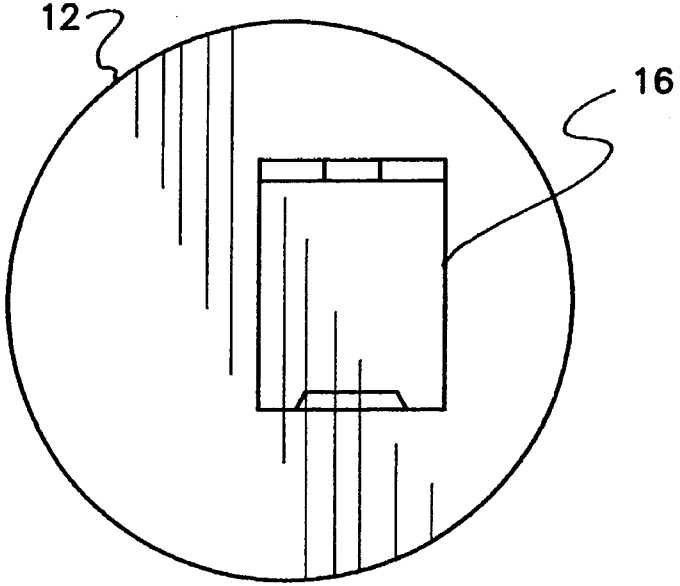
FIG. 3 is a rear view of the novel stimulator.
Figure 2:
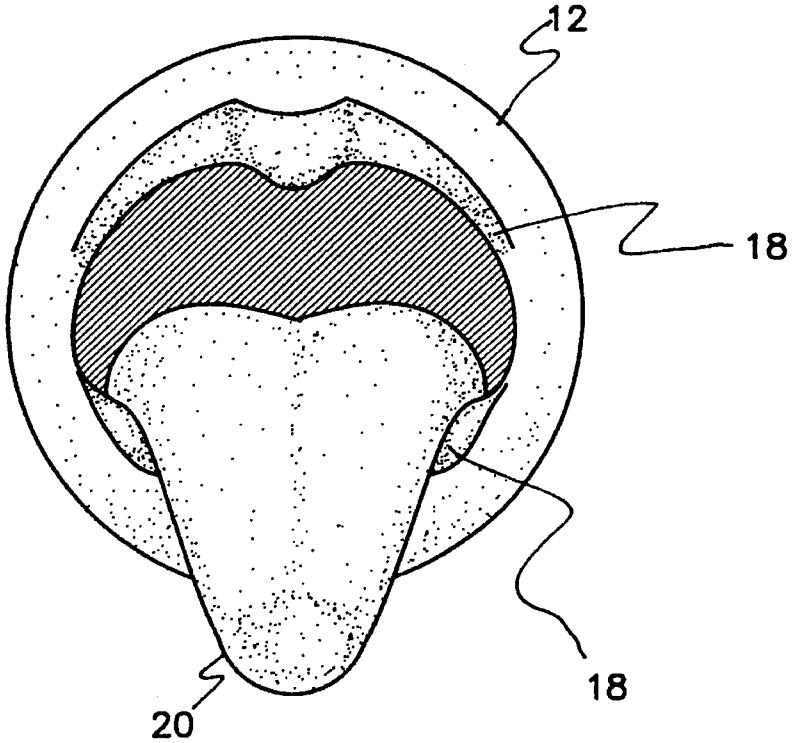
FIG. 2 is a front view of the novel stimulator.

Forward end 14 and the relation of tongue 20 to the opening are also seen in the view of FIG. 2. FIG. 3 shows the rear end of housing 12. A door 16 opens to a battery compartment. The preferred embodiment of the present invention is battery powered, and at least one battery cell 17 is stored within housing 12, as seen in FIG. 1, and connected in well known fashion.

Figure 5:
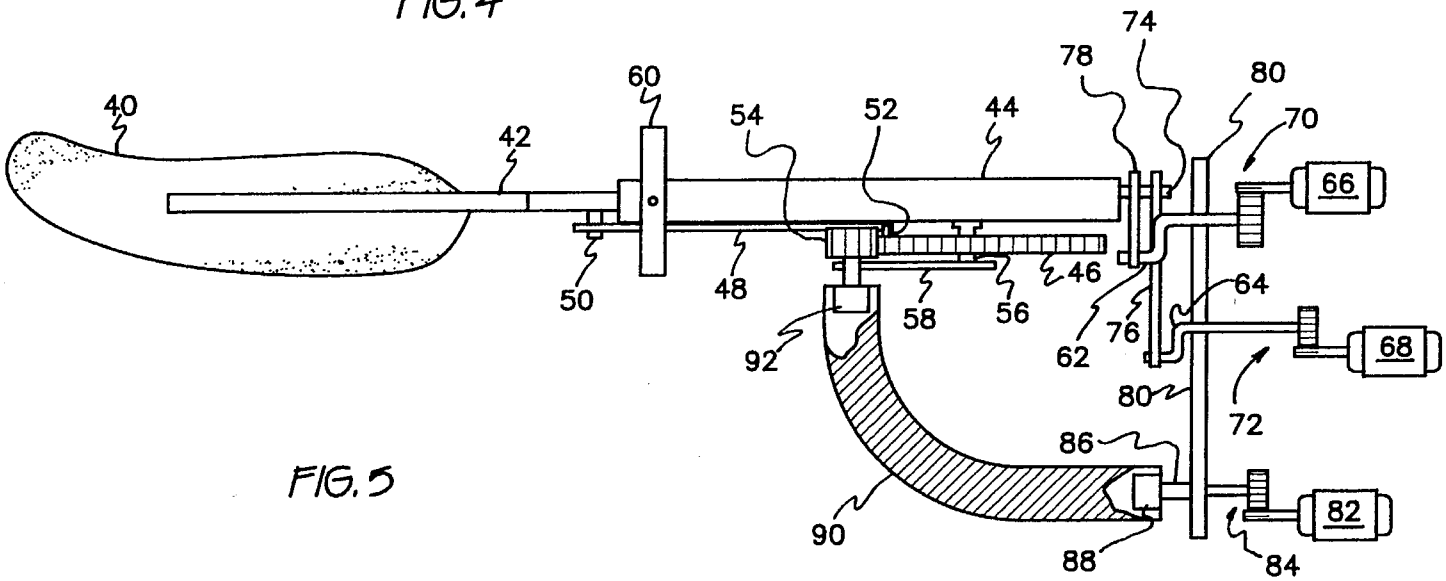
FIG. 5 is a side view of the components of FIG. 4.

Shown in FIG. 1 are control buttons and associated switches 22,24,26 close electrical circuits from the batteries to each of three motors (see FIG. 5). These switches 22,24, 26 provide controls for starting and stopping reciprocation, vertical motion, and lateral motion of simulated tongue 20, as will be further explained hereinafter.

Control buttons and associated switches 28,30,32 are provided for varying the voltage applied to the motors, so that the speed at which these motors operate is selectively varied. These switches 28,30,32 provide speed controllers controlling the speed of the reciprocation, vertical motion, and lateral motion discussed above. Switches 22,24,26,28, 30,32 are located on and external to housing 12.

Conventional switches and conductors are provided to achieve the circuitry required to accomplish the control scheme set forth above. It will occur to those of ordinary skill in the art to arrange connection among the battery cells, motors, and switches as required, and further detail will not be provided.

The feminine stimulator 10 may be made from any of a number of latex products resembling in both texture and movement those of a human mouth, lips and tongue. In addition, stimulator 10 has a finger operated, plunger type pump 34 for discharging a lubricant onto tongue 20, to prevent damage to the stimulator or the clitoris or vagina of a human female while stimulator 10 is in use. Pump 34 includes a finger operated plunger 36 and a delivery conduit 38.

Figure 4:
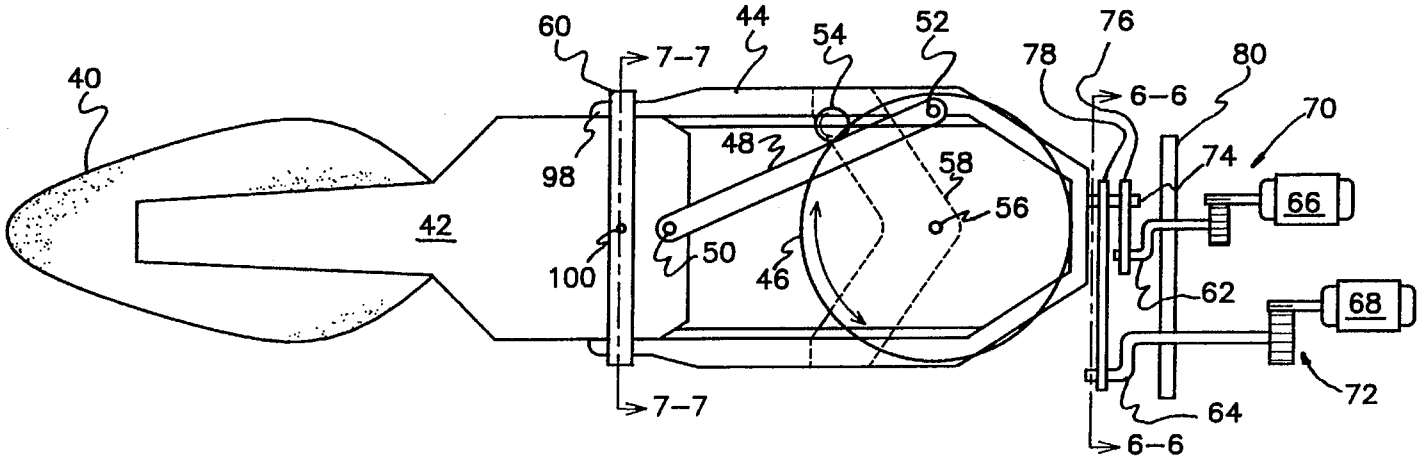
FIG. 4 is a top plan view of internal components of the novel stimulator shown isolated from the housing for clarity.

Turning now to FIG. 4, the motive systems operating tongue 20 in the manner described above will now be described. Tongue 20 comprises a soft, pliable external portion 40, as may be fabricated from a soft, yielding latex material, mounted upon a rigid metal base 42. Base 42 rides in a generally U-shaped guide 44, and is constrained to slide forwardly and backwardly therein, or reciprocate, with respect to forward and rear ends (see FIGS. 1 and 3, respectively). Base 42 mechanically interfits guide 44 in a manner to be set forth hereinafter.

Base 42 is reciprocatingly driven from a wheel 46 by a connecting rod 48. Rod 48 is journaled at 50 and 52 to base 42 and to wheel 46. Wheel 46 is geared to a drive wheel 54, with suitable speed reduction as required to match the output of an associated motor, explained hereinafter, to speeds generally considered appropriate for reciprocation of tongue 20. Wheel 46 rotates on axle 56, and is supported in place by secure journalling of axle 56 in a support strut 58 fixed to U-shaped guide 44.

FIG. 4 also shows certain components employed to induce up and down motion and side to side motion of tongue 20. It will be seen that guide 44 is surrounded by a ring 60, to which guide 44 is journaled. In turn, ring 60 is surrounded by and journaled within housing 12. The relation of guide 44, ring 60, and housing 12 is described further hereinafter.

The significance of the above arrangement of journaling of guide 44 and ring 60 may be summarized as follows. The axes of pivot of guide 44 with respect to ring 60, and of ring 60 with respect to housing 12 are normal to one another. It therefore follows that when guide 44 pivots back and forth in an arc about its pivot axis, tongue 20 will respond with corresponding change in inclination. Similarly, when ring 60 is so manipulated, tongue 20 will respond with an inclination in a plane normal to the plane of inclination correlated to guide 44. Thus, tongue 20 is inclined in either or both of two orthogonal planes in response to appropriate manipulation. This results in the up and down motion and the side to side motion discussed previously.

Manipulation of guide 44 and of ring 60 is achieved by driving associated cranks 62,64 from associated motors 66,68. The output of motors 66 and 68 is reduced as required, as at reduction gear sets 70,72. Of course, it will be obvious to one skilled in the art that gear sets 70,72 may comprise a larger number of gears to effect the necessary reduction ratio, and that therefore the depiction of this Drawing Figure is merely representative.

Cranks 62 and 64 act on a pin 74 by connecting rods 76 and 78, respectively. Preferably, cranks 62 and 64 are journaled in and supported by a plate 80. Plate 80 also separates the cylindrical interior of housing 12 into a forward chamber housing motion translation components, and a rear electrical chamber housing batteries, motors, and controls.

Omitted from FIG. 4 for clarity are drive elements for rotating wheel 46. These elements are illustrated with reference to FIG. 5. A third motor 82 transmits rotary motion through a suitable reduction gear set 84 to a shaft 86. Shaft 86 has an enlarged head 88 for engaging a long coil spring 90. Spring 90 extends and is anchored to a shaft 92 which drives wheel 54.

Spring 90 is long and in the form of a coil spring in order to reach shaft 92 while simultaneously accommodating the various motions of tongue 20 which are incidentally imposed upon shaft 92 by the mounting arrangement of these components. Spring 90 must rotate in order to drive shaft 92 while accommodating the potentially compound motions experienced by tongue 20.

Figure 6:
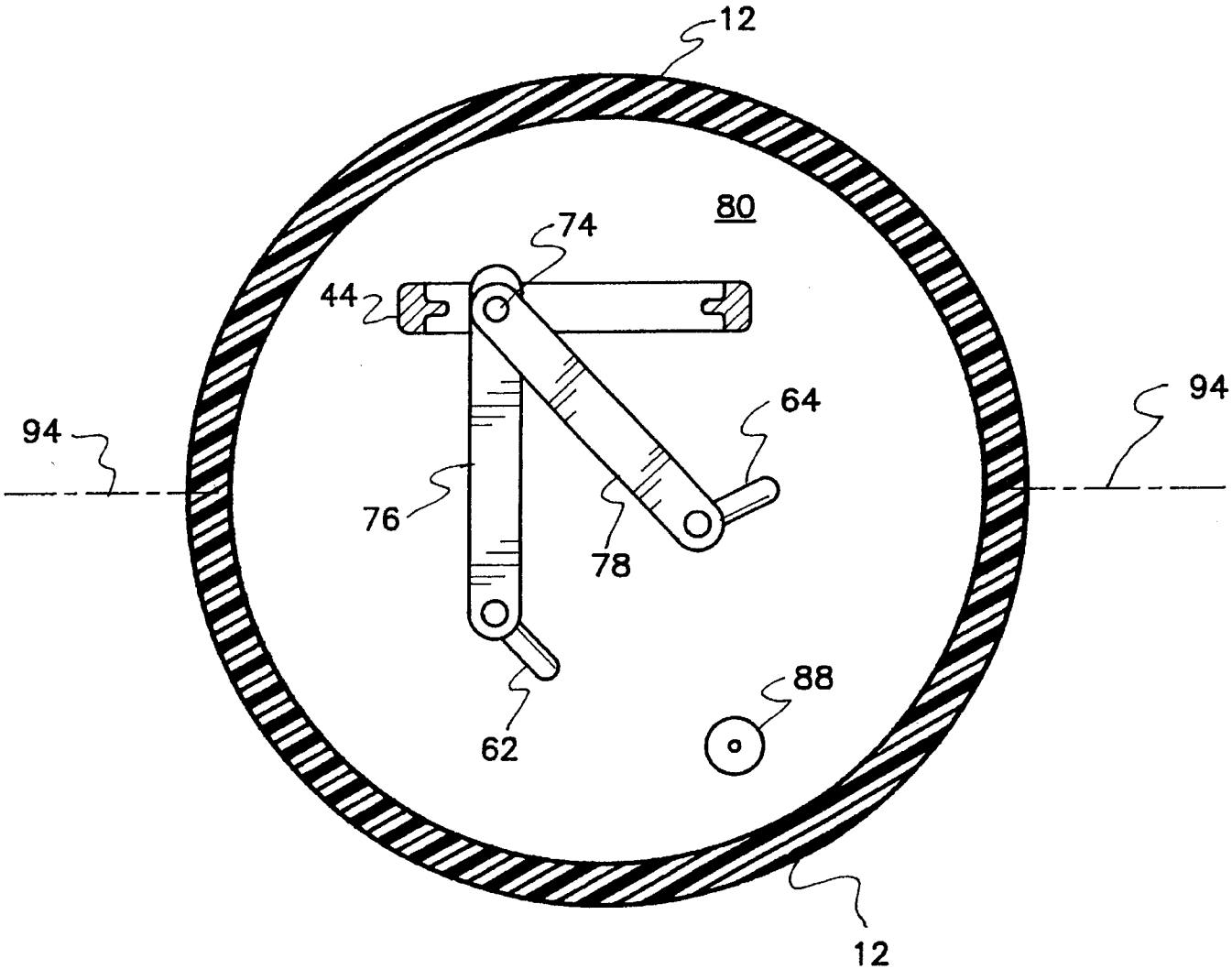
FIG. 6 is a front end elevational view of internal components of the novel stimulator taken along line 6—6 of FIG. 4, and shown isolated from other components for clarity.

FIG. 6 shows how output of motors 66 and 68 effect the desired inclinations ultimately imposed upon tongue 20 (see FIG. 4). Cranks 62 and 64 move respective connecting rods 76 and 78. It will be noted from examination of this Drawing Figure that due to the angles at which rods 76 and 78 are oriented with respect to pin 74, each rod 76 or 78 contributes a different orthogonal input to pin 74. As depicted, rod 76 imparts a reciprocating, substantially vertical motion to pin 74, and rod 78 imparts a reciprocating, substantially side to side, or horizontal motion to pin 74.

Pin 74 is formed integrally with guide 44, and input motions imparted to the one are thus also imparted to the other. Thus guide 44 receives either an input motion ultimately moving tongue 20 (see FIG. 4) up and down, an input motion moving tongue 20 side to side, or both inputs simultaneously.

Figure 7:
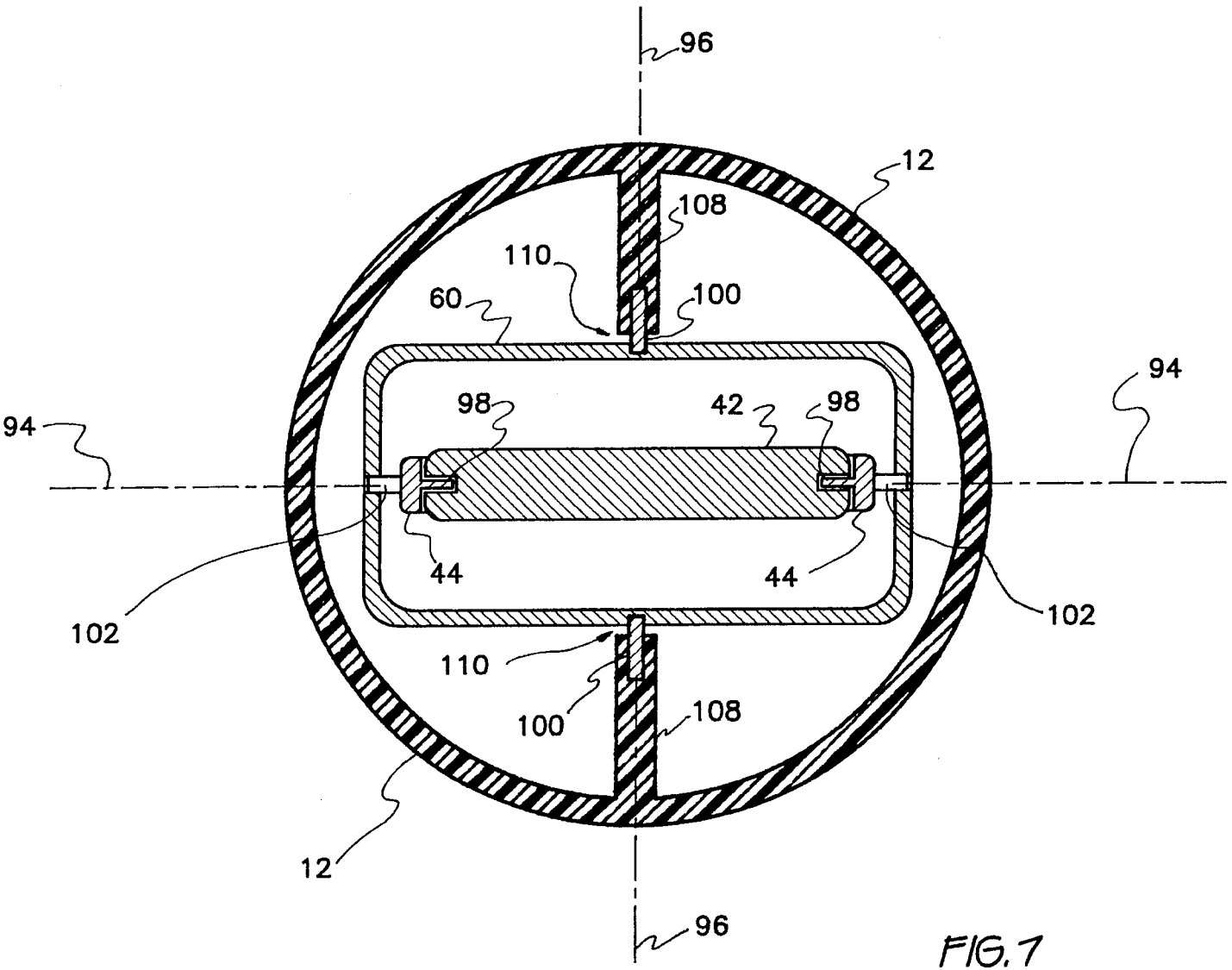
FIG. 7 is a front end elevational view of internal components of the novel stimulator taken along line 7—7 of FIG. 4, and shown isolated from other components for clarity.

FIG. 7 clearly shows the orthogonal journalling of guide 44 within ring 60 and of ring 60 within housing 12. The orthogonal arrangement of axes 94 and 96 thus define a universally pivotable joint, and the simultaneous motions are thus accommodated.

In FIG. 7, housing 12 is shown to comprise mating shells. This merely reflects one possible fabrication technique, and is not critical to the invention. In a similar vein, it is anticipated that housing 12 would be made from a synthetic resin, whereas internal motion translation components would be made from metal. It will be appreciated that any suitable material would be acceptable to form any particular component.

Figure 8:
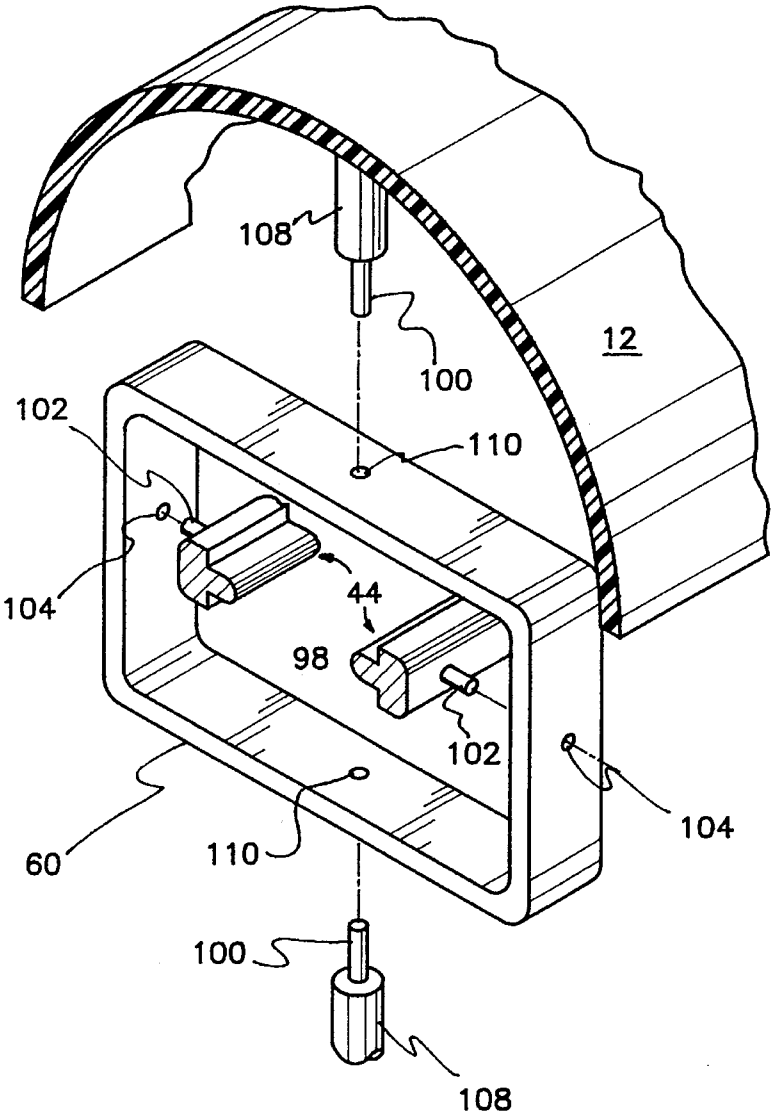
FIG. 8 is an exploded perspective detail view of pivoting components shown in front elevation in FIG. 7.

A more literal rendering of the critical pivoting components described above is provided by FIG. 8. In this view, guide 44 is exaggerated as seen. In a working model, guide 44 would be sufficiently wide as to abut ring 60 in the manner shown in FIG. 7. Guide 44 has a pivot pin 102 on each side, for engaging a corresponding hole 104 formed in ring 60.

Not critical to pivoting, but also seen in this view is rail 98, which engages a corresponding groove 106 formed in base 42 (see FIG. 7), so that guide 44 and base 42 are operatably and slidably held together.

Ring 60, in turn, pivots with respect to housing 12. This arrangement is enabled by pivot pins 100, anchored within boss 108 formed integrally with housing 12. Pivot pins 100 engage corresponding holes 110 located in ring 60.

Although the above description contemplates using electric motors which have rotary outputs, this is not required to practice the invention. For example, linear motors or solenoids could be employed to the same effect, with appropriate modification to the motion translating components.

Also, other sources of power could be used to power either rotary or linear motors, such as pneumatic pressure.

In still other variations of the specific embodiment set forth above, the number of motors may be varied and accommodated by suitable motion translation components.

The number and purpose of switches and controls may also be modified to suit specific requirements.

It is to be understood that the present invention is not limited to the sole embodiment described above, but encompasses any and all embodiments within the scope of the following claims.

I claim:

1. A portable hand-held vibratory feminine stimulator tier the performance of a simulation of cunnilingus, comprising:

a generally cylindrical housing having means defining a forward chamber and means defining a rear chamber;

a stimulating member comprising a soft, pliable external portion, for yieldingly contacting and stimulating the vagina and clitoris of a user, said stimulating member employable to penetrate and stimulate a female vagina, said stimulating member having a tip, said stimulating member projecting in reciprocating fashion from said forward housing of said housing;

first, second and third motors located within said rear chamber of said housing for providing motive power to said stimulating member; and motion translation components contained within said forward chamber for selectively causing said stimulating member to move in reciprocating fashion so as to enter and withdraw from the vagina of the user, and to cause said tip of said stimulating member to move up and down, said motion translation components further comprising first motion translation linkage means connected between the first motor and the stimulating member for converting rotary output motion from said first motor to reciprocating motion moving said stimulating member, second motion translation linkage means connected between the second motor and the stimulating member for converting rotary output motion from said second motor to vertical or up and down motion moving said stimulating member, third motion translation linkage means connected between the third motor and the stimulating member for converting rotary output motion from said third motor to lateral or side to side motion moving said stimulating member, and switch means located on the housing for selectively and simultaneously controlling each of the motors.

2. The feminine stimulator according to claim 1, the switch means further comprising switches controlling said first motor, said second motor, and said third motor, said switches located on and external to said housing.

3. The feminine stimulator according to claim 2, further comprising at least one battery cell located within said rear chamber, electrically connected through said switches to provide power to said first motor, said second motor, and said third motor.

4. The feminine stimulator according to claim 2, said switches comprising a first switch controlling said first motor, a second switch controlling said second motor, and a third switch controlling said third motor, said first switch said second switch, and said third switch operating independently of one another.

5. The feminine stimulator according to claim 1, said stimulating member further comprising a rigid base riding in a guide, said guide constraining said base to slide forwardly and backwardly therein, whereby reciprocation of said stimulating member is enabled.

6. The feminine stimulator according to claim 5, further including a ring and first journals pivotally supporting said ring within said housing, said guide further comprising second journals pivotally supporting said guide within said ring, said first journals and said second journals having axes disposed orthogonally, thereby forming a universally pivotable joint accommodating up and down and side to side motions individually and in combination, whereby up and down and side to side motions of said stimulating member are enabled.

7. The feminine stimulator according to claim 6, said first motion translation components further comprising a wheel and a connecting rod attaching to said wheel by a third journal and to said base by a fourth journal, said wheel drivingly connected to said first motor, whereby reciprocating motion acting upon said stimulating member is derived from rotary motion of said first motor.

8. The feminine stimulator according to claim 6, said guide further comprising a pin for accepting motion inputs acting on said guide, said second motion translation components comprising a second connecting rod and a first crank driven by said second motor, said second connecting rod imparting up and down motion to said pin responsive to rotation of said first crank, and said third motion translation components comprising a third connecting rod and a second crank driven by said third motor, said third connecting rod imparting side to side motion to said pin responsive to rotation of said second crank, whereby up and down motion and side to side motion acting on said stimulating member are derived from rotary motion of said second motor and said third motor.

9. A portable hand-held vibratory feminine stimulator for the performance of a simulation of cunnilingus, comprising:

a generally cylindrical housing having means defining a forward chamber and means defining a rear chamber;

a stimulating member comprising a soft, pliable external portion, for yieldingly contacting and stimulating the vagina and clitoris of a user, said stimulating member employable to penetrate and stimulate a female vagina, said stimulating member having a tip, said stimulating member projecting in reciprocating fashion from said forward housing of said housing;

first, second and third motors located within said rear chamber of said housing for providing motive power to said stimulating member;

motion translation components contained within said forward chamber for selectively causing said stimulating member to move in reciprocating fashion so as to enter and withdraw from the vagina of the user, and to cause said tip of said stimulating member to move up and down and side to side, said motion translation components further comprising first motion translation linkage means connected between the first motor and the stimulating member for converting rotary output motion from said first motor to reciprocating motion moving said stimulating member, second mechanical linkage means connected between the second motor and the stimulating member for converting rotary output motion from said second motor to vertical or up and down motion moving said stimulating member, and third mechanical linkage means connected between the third motor and the stimulating member for converting rotary output motion from said third motor to lateral or side to side motion moving said stimulating member; and a first switch controlling said first motor, a second switch controlling said second motor, and a third switch controlling said third motor, said first switch, said second switch, and said third switch operating independently of one another, said first switch, said second switch, and said third switch located on and external to said housing.

10. The feminine stimulator according to claim 9, further comprising at least one battery cell located within said rear chamber, electrically connected through said switches to provide power to said first motor, said second motor, and said third motor.

11. The feminine stimulator according to claim 9, said stimulating member further comprising:

a rigid base and a guide, said base riding in said guide and said guide constraining said base to slide forwardly and backwardly therein; and said motion translation components further comprising a ring and first journals pivotally supporting said ring within said housing, said guide further comprising second journals pivotally supporting said guide within said ring, said first journals and said second journals having axes disposed orthogonally, thereby forming a universally pivotable joint accommodating up and down and side to side motions individually and in combination.

12. The feminine stimulator according to claim 11, said guide further comprising a pin for accepting motion inputs acting on said guide, said second motion translation components comprising a second connecting rod and a first crank driven by said second motor, said second connecting rod imparting up and down motion to said pin responsive to rotation of said first crank, and said third motion translation components comprising a third connecting rod and a second crank driven by said third motor, said third connecting rod imparting side to side motion to said pin responsive to rotation of said second crank.

13. The feminine simulator according to claim 9, said first motion translation components further comprising a wheel and a connecting rod attaching to said wheel by a third journal and to said base by a fourth journal, said wheel drivingly connected to said first motor, whereby reciprocating motion acting on said stimulating member is derived from the rotary motion of said first motor.

14. A portable hand-held vibratory feminine stimulator for the performance of a simulation of cunnilingus, comprising:

a generally cylindrical housing having means defining a forward chamber and means defining a rear chamber;

a stimulating member comprising a soft, pliable external portion, for yieldingly contacting and stimulating the vagina and clitoris of a user, said stimulating member employable to penetrate and stimulate a female vagina, said stimulating member having a tip, said stimulating member projecting in reciprocating fashion from said forward housing of said housing, said stimulating member further comprising a rigid base and a guide, said base riding in said guide and said guide constraining said base to slide forwardly and backwardly therein;

first, second and third motors located within said rear chamber of said housing for providing motive power to said stimulating member;

motion translation components contained within said forward chamber for selectively causing said stimulating member to move in reciprocating fashion so as to enter and withdraw from the vagina of the user, and to cause said tip of said stimulating member to move up and down, said motion translation components further comprising a ring and first journals pivotally supporting said ring within said housing, said guide further comprising second journals pivotally supporting said guide within said ring, said first journals and said second journals having axes disposed orthogonally, thereby forming a universally pivotable joint accommodating up and down and side to side motions individually and in combination, and said guide further comprising a pin for accepting motion inputs said motion translation components further comprising first motion translation linkage means connected between the first motor and the stimulating member for converting rotary output motion from said first motor to reciprocating motion moving said stimulating member, further comprising a wheel and a connecting rod attaching to said wheel by a third journal and to said base by a fourth journal, said wheel drivingly connected to said first motor, reciprocating motion acting on said stimulating member thus being derived from rotary motion from said first motor, second mechanical linkage means connected between the second motor and the stimulating member for converting rotary output motion from said second motor to vertical or up and down motion moving said stimulating member, further comprising a second connecting rod and a first crank driven by said second motor, said second connecting rod imparting up and down motion to said pin responsive to rotation of said first crank, and third mechanical linkage means connected between the third motor and the stimulating member for converting rotary output motion from said third motor to lateral or side to side motion moving said stimulating member, further comprising a third connecting rod and a second crank driven by said third motor, said third connecting rod imparting side to side motion to said pin responsive to rotation of said second crank; and a first switch controlling said first motor, a second switch controlling said second motor, and a third switch controlling said third motor, said first switch, said second switch, and said third switch operating independently of one another.

* * * * *